United States Patent [19]

Perry

[11] Patent Number: 5,015,274

[45] **Date of Patent: * May 14, 1991**

[54] HIGH EFFICIENCY INDUSTRIAL VACUUM CLEANER AND FILTER ELEMENT

[75] Inventor: Timothy J. Perry, Danville, Calif.

[73] Assignee: Mello Manufacturing, Inc., Richmond, Calif.

[ * ] Notice: The portion of the term of this patent subsequent to Jun. 13, 2006 has been disclaimed.

[21] Appl. No.: 358,653

[22] Filed: May 26, 1989

Related U.S. Application Data

[63] Continuation-in-part of Ser. No. 47,894, May 7, 1987, Pat. No. 4,838,907.

[51] Int. Cl.[5] ..... B01D 46/00

[52] U.S. Cl. ..... 55/97; 55/381; 55/467; 55/482; 55/350; 55/528

[58] Field of Search ..... 55/DIG. 45, 528, 97, 55/381, 350, 429, 467, 471–473, 482; 210/499

[56] References Cited

U.S. PATENT DOCUMENTS

| | | | |
|---|---|---|---|
| 2,025,946 | 12/1935 | Wenner-Gren | 55/357 |
| 2,198,568 | 4/1940 | Yonkers | 183/37 |
| 2,295,984 | 9/1942 | Wilson | 55/472 |
| 2,713,921 | 7/1955 | Turner | 183/60 |
| 3,046,718 | 7/1962 | Ide et al. | 55/470 |
| 3,365,864 | 1/1968 | Iizima | 55/471 |
| 3,503,106 | 3/1970 | Port et al. | 139/420 R |
| 3,505,792 | 4/1970 | Dahlem | 55/528 |
| 3,609,946 | 10/1971 | Nakagawa | 55/296 |
| 3,653,189 | 4/1972 | Miyake et al. | 55/288 |
| 3,653,190 | 4/1972 | Lee | 55/302 |
| 3,835,626 | 9/1974 | Miyake et al. | 55/319 |
| 3,966,434 | 6/1976 | Frazier | 55/97 |
| 4,072,483 | 2/1978 | Doyle | 55/372 |
| 4,257,791 | 3/1981 | Wald | 55/382 |
| 4,277,266 | 7/1981 | Dick | 55/381 |
| 4,336,035 | 6/1982 | Evenstad | 55/97 |
| 4,587,997 | 3/1986 | Brooks | 139/420 R |
| 4,695,299 | 9/1987 | Spadaro | 55/429 |
| 4,838,907 | 6/1989 | Perry | 55/381 |

*Primary Examiner*—Bernard Nozick
*Attorney, Agent, or Firm*—O'Keefe & Wilkinson

[57] ABSTRACT

A vacuum cleaner uses a special self-cleaning filter arrangement including an initial fabric filter having a relatively large mesh size with a broad open mesh ratio of 5 to 11 flat filter threads 0.025 to 0.045 inches in width defining oblong filter openings 0.002 to 0.006 inches in width and having a length not greater than will maintain the structural integrity of the filter openings and a total opening area of 5 to 45 times the cross section of the inlet, which inlet faces away from the filter. The initial filter is preferably backed up by secondary filters which filter particulates passing through the initial fabric filter especially during startup and while the filter cleans itself.

18 Claims, 3 Drawing Sheets

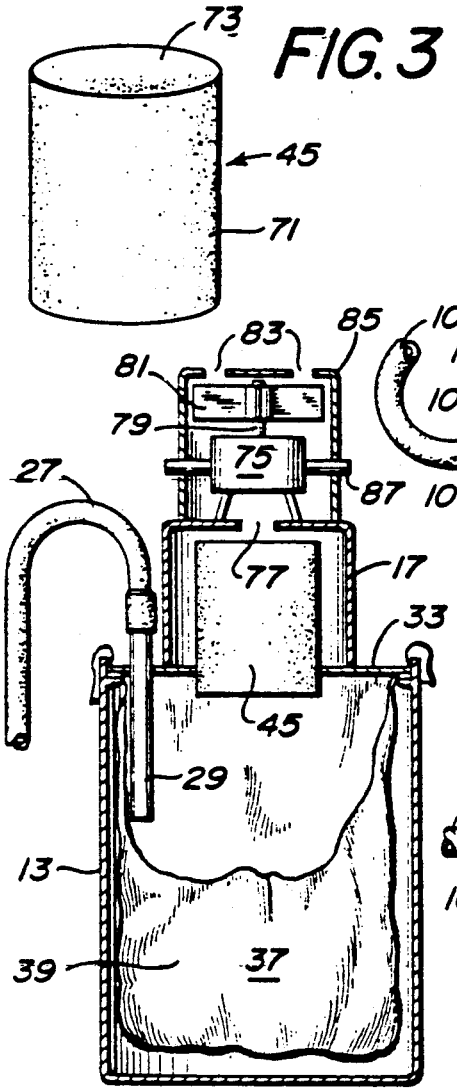
FIG. 3
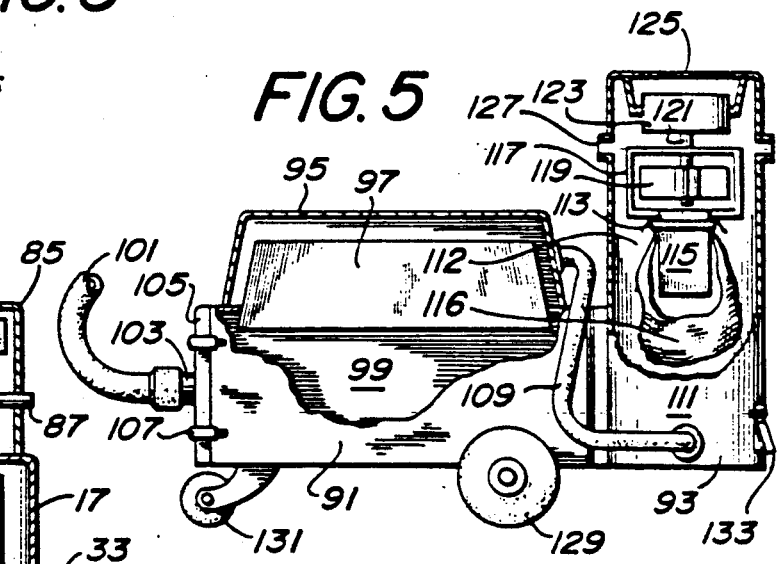
FIG. 5
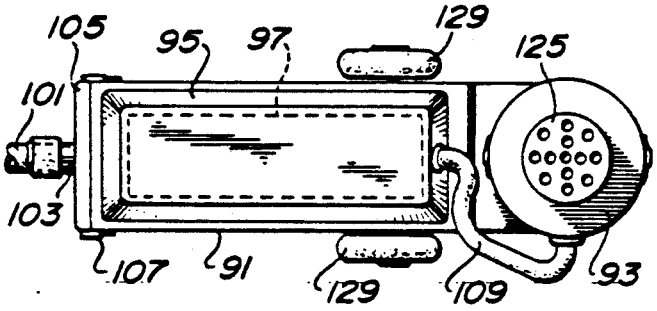
FIG. 6
FIG. 4
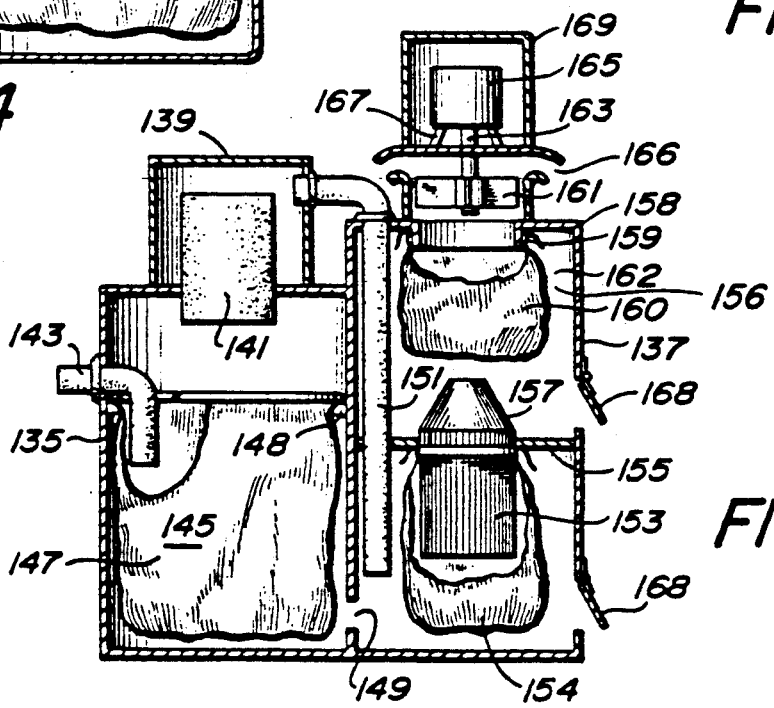
FIG. 7

HIGH EFFICIENCY INDUSTRIAL VACUUM CLEANER AND FILTER ELEMENT

CROSS REFERENCE TO RELATED APPLICATIONS

This application is a continuation-in-part of U.S. application Ser. No. 047,894 filed May 7, 1987 now U.S. Pat. No. 48 38907.

BACKGROUND OF THE INVENTION

1. Field of the Invention

This invention relates to vacuum or suction cleaners and more particularly to high efficiency vacuum cleaners, preferably incorporating multiple filter stages, in which the initial filter stage is self-cleaning by reason of the use of a particularly designed relatively coarse mesh filter material positioned over a debris or particulate collection chamber, preferably containing an impervious dust or particulate collection bag.

2. Description of the Prior Art

A large number of so-called vacuum or suction cleaners have been designed in the past. Such cleaners have usually involved the use of rotary fan means to either draw dust laden air through a perforate filter medium such as a cloth bag or the like or to blow dust laden air into a filter such as a filter bag. Particles of dust or other debris are caught by the filter material while the air passes through. As additional dust and debris is built up on the filter material, the pores or openings in the filter become partially blocked with dust and other particulates. The resulting accumulation of dust itself eventually becomes a filter of sorts and the efficiency of the filter action at first increases. Beyond a certain point, however, the efficiency of the filter decreases as the filter medium becomes more impervious to air due to a thick layer of dust and other debris accumulated on the surface of the filter. Multiple stage filtering has been used to increase the efficiency of filtering and the length of the filtering cycle, i.e. the length of time between cleaning or emptying the filter. The initial filter medium in such arrangements is usually coarser, or in other words, has larger holes or meshes in it, than subsequent filters. The dust accumulated is in such multiple stage filtering arrangements distributed between the multiple filter mediums with the larger particles being collected on the coarser initial filter medium or mediums and the smaller particles being caught on the finer filter medium or mediums. This extends the filter cycle of all the filter mediums, but is not always worth the trouble, since there are then more filters to be changed less frequently rather than less filters to be changed more frequently and the trade off is not always advantageous. Of course, the filter stages can be arranged so that the mesh size of one or more of the filters is such that the particular filter accumulates more than its share of particulates and dust so only one filter at a time usually has to be changed or cleaned. This, however, essentially defeats the original aim of increasing the number of stages in the filter cycle.

Multiple layer filters or filter mediums rather than multiple filters have also been used. Multiple layer filters are comprised usually of somewhat erratically laid fibers or matted fibers, rather than a woven or geometrically oriented fiber arrangement forming a sheet or cloth. Such multiple layer filters have the advantage of being less easily blinded by particulates because the openings can be larger than the particulates to be removed from an air stream. This is because the openings can be larger than the particulates to be removed from an air stream. The opening can be larger because the effective passages, or openings, provided through the filter medium are tortuous with the result that particulates impact the various fibers of the filter medium as such particulates are carried through the tortuous passages by the air stream. The particulates are consequently removed from such air stream by their impacts with the fibers, either by adhering to the fibers or becoming entangled in multiple fibers.

So-called filter aids are also sometimes used with a filter to increase the filtering efficiency. Such filter aids, which are usually fibrous in nature, are placed upon a filter and, in effect, convert a single layer filter to a multiple layer filter. They not only enable smaller particulates to be removed from an air stream than might otherwise be possible with the primary filter, but also serve frequently to prevent blinding or clogging of a filter having a relatively small mesh size. Such prevention of blinding and clogging is accomplished by, in effect, holding larger sized particulates away from the smaller filter orifices. Since filter aid materials must be applied periodically to the principal filter, use of such materials is practical usually only for laboratory environments or specialized industrial environments and not readily adaptable for vacuums or suction-type apparatus or cleaners.

Some vacuum or suction systems have also provided cleaning means such as scrapers, rappers, backflow systems and the like to aid in cleaning the filters and particularly an initial coarse filter, but such arrangements add considerable complication to the apparatus. Thus, while the filter cycle may be lengthened, the extra expense and complication is a considerable disadvantage. In addition, scrapers and rappers sometimes tend to force dust and dirt through the mesh of the filter causing an overall decrease in filter efficiency. Such systems also tend to remove a large portion of the accumulation of dust from the filter surface so that a new layer of dust must accumulate before efficient filtering can take place. Some scrapers are arranged only to remove a certain portion of the dust accumulation by passing the scraper along the filter at a predetermined distance from the filter surface. However, this type of arrangement tends to compact the remaining particulate accumulation on the filter at the same time and this interferes with the efficiency of the filter. Backflow-type arrangements which periodically force dust layers from the filter surface are inefficient since the vacuum or suction filtration cycle cannot operate while the backflow is operating and the time available for actual cleaning or suction is thus considerably decreased. While a judicious selection of filter stages may alleviate many of the above enumerated difficulties, the principal difficulty of intermittent operation due to the necessity of periodically cleaning one or more of the filters remains. The following U.S. patents are examples of the present stage of the prior art as described above.

U.S. Pat. No. 2,198,568 issued Apr. 23, 1950 to E.H. Yonkers discloses a self-cleaning suction cleaner which uses a filter medium sold under the name of Dextilose. The filter material is treated with viscose to form a smooth satin finish. The viscose coating prevents adhesion of dust to the filter medium so that "a heavy accumulation of dust and dirt is not possible, the dust and dirt flaking off from the action of gravity aided by the draft of incoming air and falling into the container below." The filter thus tends "to maintain itself in a clean condition."

U.S. Pat. No. 2,295,984 issued Sep. 15, 1942 to B.C. Wilson discloses a shop-type vacuum in which air enters a canister where it drops out a considerable amount of its particulate matter which is thereby removed and the air then passes upward into an inverted filter and removes additional particulates. The filtering cylinder or bag collapses each time the cleaner is shut off so the accumulation of dirt falls into the lower portion of the canister leaving the filter bag free to pass a maximum amount of air when the cleaner is again activated.

U.S. Pat. No. 2,713,921 issued July 26, 1955 to J. Turner discloses a filtering arrangement in which a spiral wiping bar wipes the inside of a cylindrical filter medium to remove accumulated dust. The wiping spiral leaves a sufficient build-up of particulate material on the filter to allow the filtering of finer particles to continue. Turner is only one example of a large number of prior devices for physically removing dust from filter surfaces.

U.S. Pat. No. 3,653,189 issued Apr. 4, 1972 to Y. Miyake, et al. discloses a two-stage filter vacuum cleaner. The initial discussion in the patent discloses that in order to allow a longer vacuum period it has previously been known to use a two-stage filtering system comprising a dust collecting receptacle with a filtering screen of relatively large mesh size and a second fine mesh size filtering medium located immediately down-stream from the first coarse filtering screen. The invention of the patent involves a two-stage filtering arrangement including a first coarse filter screen made of plastic material, fine metal wires or the like and having a relatively large mesh size. Immediately behind is a main filtering means comprising a filter cloth having a fine mesh size which collects the finer dust particles. Also disclosed is a vibrator for use in shaking the dust from the main filter cloth.

U.S. Pat. No. 3,609,946 issued June 28, 1968 to H. Nakagawa et al. discloses a two-stage electric suction cleaner including a relatively coarse mesh filter and a finer mesh filter. As disclosed, the coarse filter is less susceptible to clogging and the finer mesh filter does not have to handle as much dust as it would in the absence of the coarse filter. The period of cleaning is thus increased. As disclosed, the size of the holes, particularly in the coarse filter, is closely related to the period of efficient dust collection. This relationship is shown in the graph in FIG. 8 of the patent. FIGS. 10, 11 and 12 disclose a dual arrangement including two concentric bag or cylinder-type filter means.

U.S. Pat. No. 3,653,190 issued Apr. 4, 1972 to W.J. Lee et al. discloses a vacuum cleaner arrangement including a lower canister which may be lined with a plastic bag or bags to receive detritus dropped from a series of upper filter mediums. A vacuum arrangement is provided in the walls and bottom of the canister to hold the plastic bag against the sides of the canister.

U.S. Pat. No. 3,835,626 issued Sep. 17, 1974 to Y. Miyake, et al. discloses a two-stage vacuum cleaner incorporating a first relatively coarse mesh adjacent a dust storage chamber followed by a conventional cloth filter which accomplishes the final filtering of fine dust particles. The initial filter screen may be made of plastic materials, fine metal wire, or the like and has a relatively large mesh size. The second filter means is in the form of a dust collecting bag made from cloth or the like for collection of fine dust particles. The two-stage filtering arrangement provides longer time periods between filter cleaning cycles.

While prior devices such as shown in the Yonkers 2,198,506 patent, where the filter medium is smooth and non-adherent so large accumulations of dust cannot form, and the Wilson patent 2,295,984 where the filter collapses at the ends of a suction cycle causing dust to be ejected, are in effect self-cleaning, such devices have not proved completely satisfactory since in most cases too much dust is removed, seriously decreasing the efficiency of the filtering action and in the case of the Wilson arrangement the filter cleaning cycle only occurs when the filtering cycle is interrupted.

OBJECTS OF THE INVENTION

It is a primary object of the present invention, therefore, to provide an industrial vacuum-type cleaner which is substantially self-cleaning.

It is a further object of the invention to provide a multiple stage vacuum cleaner which can be used for the collection of extremely fine or toxic, acid or otherwise dangerous materials.

It is a still further object of the invention to provide a combination of filter cycles and a filter arrangement whereby toxic materials can be deposited in a closed bag or other receptacle, both during cleaning of the surroundings and self-cleaning of the filter apparatus and which is easily disposable thereafter.

It is a still further object of the present invention to provide a filter and particularly an initial filter medium in a multi-stage vacuum or suction cleaning arrangement, which filter, because of its structure and arrangement, periodically cleans itself without interrupting the cleaning cycle and without removing all the dust accumulation and seriously interfering with the efficiency of the filtering cycle.

It is a still further object of the invention to provide a multi-stage vacuum system with very superior and enhanced efficiency due to the incorporation of a filter medium having self-cleaning characteristics and from which the filtered dust may be conveniently and efficiently removed without contamination of the immediate environment.

It is a still further object of the invention to provide an equalization arrangement between the first and subsequent stages of filtering whereby excess moisture will not be drawn between them.

Other objects and advantages of the vacuum of the invention will become evident from the following description and drawings.

BRIEF DESCRIPTION OF THE INVENTION

The present invention provides an improved vacuum or suction-type filter medium which is self-cleaning by reason of the arrangement of the flow, the size of the mesh, areas of the filter, the shape of the filter opening and the relative size of the threads and the adjacent filter openings, the shape of the threads of the filter, and the materials of the filter, and which can be used in various applications including use in toxic environments. Preferably the self-cleaning filter medium is used in combination with other stages of filtering and also with an arrangement whereby dust and other particulate matter, and particularly heavier particulate matter, is deposited in an impervious disposable plastic container or bag. A high proportion of the heavier material is deposted directly into an impervious container such as said plastic container or bag disposed below the self-cleaning filter medium. Most of the remainder of the dust and particulates is collected on the self-cleaning filter medium which is in the form of an inverted bag or closed end cylinder positioned over the impervious container in position such that as the filter periodically cleans itself the accumulation of dirt and particulates falls into the impervious container. The filtered air then passes either to the atomsphere or preferably to a further stage or stages of filtering, preferably using close-weave filter material which removes very fine dust or particulate material which has passed through the first stage filter. Only a relatively minor amount of dust or particulates will be collected on the subsequent stage filters due to the superior filtering on the first stage self-cleaning filter. Consequently, the second stage and any subsequent stage filters will only infrequently require cleaning or changing. Any such cleaning or changing will be too infrequent to interfere with substantially continuous use of the vacuum cleaner mechanism and can be carried out during normal periods of inactivity after normal working hours, between shifts or at other inactive times.

The preferred multiple filter arrangement of the invention is useful, particularly during the start up of the vacuum cleaning device before a significant layer of particulates has built up on the filter and to some extent each time the outer layer of particulates has built up on the filter and then sloughs off the filter surface. During such periods, up to 10% of the particulates in the air stream will pass through the primary filter medium of the invention, but will be caught on the secondary filters.

The filter medium used in the first stage or single stage of the apparatus, as the case may be, is preferably formed from a plastic material with a fairly course weave such as 89% to 95% shade cloth which has an opening-to-cloth ratio of 5% to 11% or even more preferably where available a 92% to 94% shade cloth having an opening-to-cloth ratio of 6% to 8%. The total open area of the filter as a whole should also be preferably at least 12 times the cross sectional area of the smallest substantial continuous length of conduit or duct which conducts dust laden air from the exterior of the apparatus to the interior. With increasing open area of the filter in relation to the inlet area up to as much as 48 times the inlet area, the filter tends to be increasingly actively self-cleaning.

In addition to the relative open-to-closed area of the primary filter medium, it has been found that the opening in the filter medium should have a width of 0.002 inches to 0.0006 inches and the individual threads should be flat on the filter side preferably having a width of between 0.03 inches and 0.035 inches. The openings should be elongated in outline and preferably oblong. Rectangular openings are convenient to form in the filter medium, but the openings could have rounded corners.

A layer of dust and particulates quickly builds up on the filter material which is disposed preferably both vertically and horizontally, i.e. on the inner portions of the sides and underside of the top of a bag or closed top cylinder of the filter material. The permeability of the filter material to air may cause a quick build-up of a dust layer which quickly acts itself as a filter medium. While the exact details of the reason the filter operates so efficiently is not completely clear at the present time, it is thought that the combination of the filter area, the size and shape of the orifices of the filter medium resulting in an optimum total air permeability of the filter medium, as well as the relative position of the filter is such that the initial layer or layers of dust and particulates are closely adherent to the filter material due to the pressure of the air passing through the dust and is opposed by gravitational force. Unlike filter mediums having a lesser amount of open space such as, for example, the popular 1% or less openings in many commercial and other type vacuum cleaners; the filter of the present invention is not quickly blinded so that a significant flow of air continues through the dust layer and the filter. As, however, the air flow decreases, particularly in the outer portions of the dust layer, the air flow exerts less force against the layers of dust accumulation and finally the weight of the layers of dust accumulation overcomes the counterforce of the air passing through the dust in the opposite direction and the outer layers of dust separate and fall into the impervious container below. The dust layers on the sides of the filter medium shear off the sides and the dust layers on the underside of the top of the filter medium peel away and drop into the underlying receptacle. The separation of the dust layers is very complete so that nearly all the dust and possibly substantially all the dust is removed from the filter material. It can be broadly stated, therefore, that it is presently believed at least that the apparatus of the invention operates so efficiently because it takes advantage of Stokes Law in maintaining particulates on the filter by the force of the air passage and then periodically partially sloughing off the outer portions of such layers.

Since the innermost layers of dust are still being acted upon by the air passing through the filter medium, particularly as the outer layers peel from the underlying layers, the immediate underlying layer may not separate from the filter medium. Thus, a filtering dust layer may usually remain on the filter medium. After the outer layer of dust and particulates falls away, a new outer layer immediately begins to form and the cycle repeats itself. Separation of the outer and inner layers of dust and particulates does not necessarily, but tends to, occur at the same point every time. The continual sloughing off of the outer layers of dust and particulates while the inner layers are retained due to the force of a high volume of air passing through the inner layers, both cleans the filter so it does not lose efficiency due to any excess accumulation of particulates and at the same time maintains its efficiency in filtering out small particulates.

The vacuum apparatus of the invention can be used not only on dry, but wet materials, and has been found to be much more efficient than previous vacuum or suction cleaners. The vacuum of the invention, as pointed out above, is particularly useful for collecting and disposing of dangerous materials such as asbestos, radioactive dust and the like because of its high efficiency in (a) sucking up small and large particulates, (b) removing all such particulates from the air stream before it is discharged to the environment, (c) safely bagging such materials for disposal, and (d) maintaining a long operating cycle between servicing and removing dust accumulation. Other advantages and details of the vacuum or suction cleaner of the invention will become evident from the following drawings and description.

While the preferred open area-to-cloth ratio of the filter medium is 6% to 8% and the total open area of the filter is preferably 12 or more times the cross sectional area of the smallest continuous internal diameter of the dust laden air inlet into the apparatus, the opening-to-cloth ratio can less preferably be 5 to 11 and the total open area filter area to inlet area can be less preferably from 8 to 48 times and less preferably still from 5 to 48 or more times the inlet area.

It is thought important that the threads of which the filter medium is formed, be substantially flat, and that the openings be oblong rather than square or the like. The filter medium is in a single layer rather than multiple layers. This provides an excellent initial and continuing flow of air through the open spaces, yet quickly builds up an effective auxiliary particulate layer and quickly filters dust and fiber particles from the air stream.

BRIEF DESCRIPTION OF THE DRAWINGS

FIG. 3 is an isometric view of the preferred filter medium of the first filter stage of the cleaner of FIGS. 1 and 2.

FIG. 4 is a schematic view of a further embodiment of the invention having only a single stage of filtering.

FIG. 5 is a partially broken away side view of a still further embodiment of the invention having a different initial filter stage.

FIG. 6 is a plan or top view of the embodiment of FIG. 5.

FIG. 7 is a still further embodiment of the invention incorporating three filter stages.

DESCRIPTION OF THE PREFERRED EMBODIMENTS

The present invention provides a superior, efficient vacuum or suction cleaner which is particularly suitable for handling dangerous materials such as toxic materials and the like, but which is also useful for normal industrial and household vacuuming of both wet and dry materials. The vacuum is rendered particularly efficient because of its use of a special open mesh filter material which provides excellent filtering of dust and particulates, particularly after a fairly heavy layer of dust and particulates are accumulated on the filter, but which is, on the other hand, self-cleaning due to the effect of gravity after a certain accumulation of dust and particulates have collected upon the filter.

Figure 1:
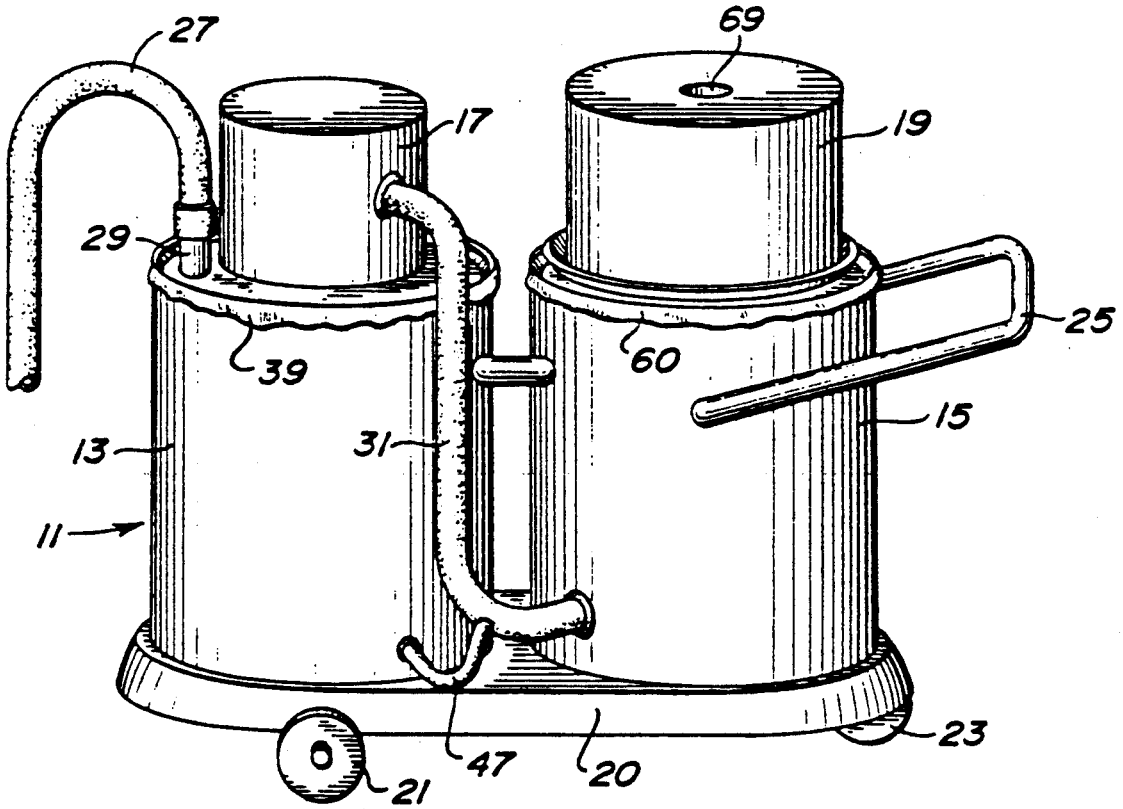
FIG. 1 is an isometric view of the exterior of one embodiment of the cleaner of the invention.

A vacuum apparatus incorporating the invention is more particularly illustrated in FIG. 1 in which the vacuum filter apparatus 11 is shown as comprising two more or less cylindrical tanks 13 and 15 having cylindrical filter and fan casings 17 and 19 respectively mounted on top. The two tank units 13 and 15 are mounted on a base 20 having two wheels 21 (only one of which is visible in FIG. 1) at one end and one swivel caster-type wheel 23 at the other end. A handle 25 is mounted upon the tank unit 15 for steering the vacuum apparatus 11. A suction hose 27 is mounted at one end of the apparatus 11 upon a suction pipe 29 which connects with the interior of tank 13 as will be more evident in FIG. 2. An interconnecting suction tube or main 31 extends between the filter casing 17 on tank 13 and the lower portion of tank 12.

Figure 2:
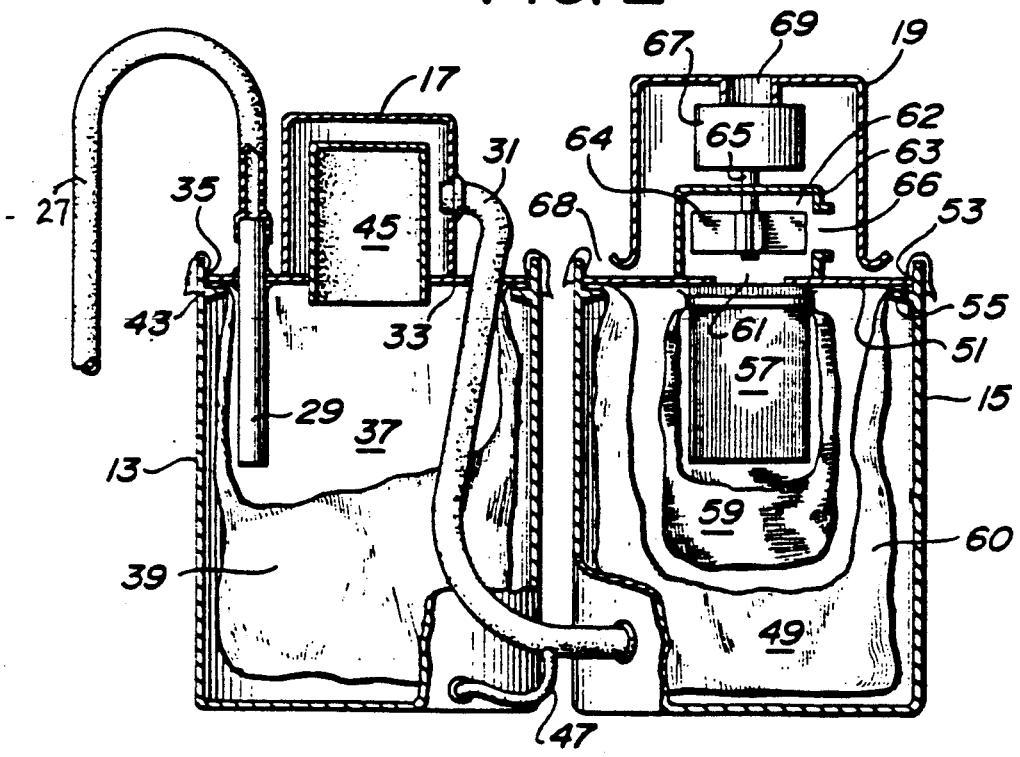
FIG. 2 is the broken away view showing the interior of the cleaner of FIG. 1.

FIG. 2 is a schematic illustration of the interior of the vacuum apparatus. In FIG. 2 it will be seen that the suction tube or pipe 29 extends downwardly into the tank 13 which is provided with a tight fitting cover 33 having a sealing edge 35 about the circumference. Within the tank 13 is a dust or debris collection chamber 37 in which is suspended an impervious plastic bag 39 which may be in the form of a strong garbage bag. This bag is simply supported by having its edges 41 folded over the top of the circumference of the tank 13 between the sealing edge 35 of the cover 33 and a corresponding sealing edge 43 on the top circumference of the tank 13. The top overlap of the plastic bag 39 thus forms in effect, a sealing gasket between top edge 43 of the tank 13 and the sealing edge 35 of the cover 33.

At the top of the chamber 37 is positioned an inverted primary filter 45 preferably made from 92% to 94% woven extruded flat polypropylene cloth and having an opening ratio of 6% to 8%. The filter cloth is formed from polypropylene or other similar suitable plastic and has a relatively loose but constant flat weave. Other materials from which the filter 45 could be formed would be, for example, polyethylene and other polyolefins.

The primary filter 45 is in the form of a cylinder with a closed top. It extends into the filter casing 17 which completely surrounds it and any vacuum or suction imposed in the casing 17 through the suction tube or main 31 completely surrounds the filter 45 from all sides. A vacuum take-off 47 from the lower portion of the suction main 31 enters the lower section of the tank 13, preferably, as shown, below the plastic bag 39 so that the same pressure or a vacuum is imposed on the outside of the plastic as is imposed on the inside. This equalization of pressure, or vacuum, prevents the bag from being drawn up into the filter 45. This essentially allows the plastic bag to remain in the exact position as it is installed by the operator. The operator should therefore take care to open the bag completely as it is installed.

As indicated, the suction tube or main 31 interconnects with the inside of the second tank 15. Tank 15 is also closed at the top with a lid 51 having a sealing edge 53 with a corresponding edge 55 on the top of the tank 15. Suspended from the top or lid 51 is HEPA (high efficiency particle air) filter 57 over which may be stretched a nylon cloth filter 59 having a very fine weave so it will remove very small dust particles from air prior to its passage through the HEPA filter. A central orifice 61 in the lid 51 provides an air passage from the HEPA filter 57 to a centrifugal chamber 62 within centrifugal casing 63 in which the blades or rotor 64 of a centrifugal fan or blower are arranged for rotation on the shaft 65 of an electrical motor 67. An air passage 66 leads from one side of the centrifugal chamber 62. An air ejection passage 68 is also provided about the lower periphery of the fan casing. While the nylon cloth filter 59 is preferred, it can be eliminated if desired or replaced by another suitable filter medium.

FIG. 3 is an isometric view of the primary or first stage filter element 45 shown in FIG. 2. It will be noted that the preferred shape of the filter is a closed top cylinder having cylindrical sides 71 and a top 73, all made preferably from the 92% to 94% polypropylene cloth.

It has been found that the primary filter 45 should also have a total open area of 12 or more times the cross sectional area of the smallest of the vacuum hose 27, the suction pipe 29 or any other substantial constriction in the passage of the dust laden air into the chamber 37.

While the filter 45 preferably has an opening area ratio of 6% to 8%, the filter may less preferably have a 5% to 10% open ratio or less preferably still, a 5% to 11% open ratio or open area ratio. Also, while it is preferable for the total open area of the filter 45 to be 12 or more times the open cross sectional area of the smallest continuous open interior section of the inlet to the chamber 37, it can less preferably be 8 to 48 times such area or less preferably still , 5 to 48 times such area.

A desirable air flow through the filter 45 during operation is from 0.2 to 1.0 cubic feet per minute per square inch (28.8 to 144 CFM per $ft^2$) of filter at a pressure drop of 3 to 20 inches of water ($H_2O$) across the filter. Depending upon conditions, however, higher or lower air flows can be used. More preferable flows are set forth below.

It is preferable for the gas permeability of the filter membrane to be no more than 0.17 cubic feet per minute per square inch at a pressure drop of about 94 inches of water.

As pointed out above, it is thought important that the individual threads from which the filter medium is formed should be substantially flat and that the openings between the threads should be oblong rather than square or the like. The filter medium should also be comprised of a single layer rather than multiple layers. In other words, most filter mediums designed for the removal of fine particulates from an air stream passing through the filter either have very small openings through which the fine particulate material cannot pass, in which case, the filter medium is quickly blocked or blinded by particulates which block the openings or pores so that air passage drops precipitously with continued use, or the filter medium is comprised of multiple layers forming in effect, tortuous passages which are, however, relatively large in cross-section. When a dust or particulate particle approaches such a multiple layer filter, the particle "sees" essentially a solid material even though such material is air permiable. Such permiability is due to the open structure of the filter medium. However, if a particulate particle approaches the filter medium at a given velocity and has a specific gravity substantially greater than that of air, it will not be able to negotiate such tortuous passages without impacting upon the sides where it is very likely to become stuck and therefore removed from the air stream. The heavier the particulate and the faster it approaches the filter medium, the more likely it is to impact upon the filter medium and be removed from the air stream. Reduced to the simplest case, if particulate material approaches a multilayer filter medium through which light cannot shine, even though such filter medium is permiable to air, any approaching particulates "see" nothing but solid and will, if such particulates have a greater density than air, impact either upon either the surface fibers or lower fibers in the filter and be removed from the air stream. Impact occurs upon the lower fibers because the heavier particulates cannot negotiate tortuous passages as readily as the air in which they are entrained. Multilayer filters are very efficient in removing particulates, but tend to plug or clog over a period and are very difficult to clean once plugged or clogged.

When approaching a single layer filter, on the other hand, a particulate, or group of particulates, will see both the filter fibers and open space and each has some calculable chance of passing through the open space depending upon how open it is and how large any given particulate is. Of course, if a particle is larger than the openings between the fibers, it will be retained upon the filter unless its momentum or the pressure gradient across its thickness from the moving air is great enough to force it through the openings either by squeezing the particulate or stretching the openings or, more usually, both. If retained on the filter medium, such particulate will almost invariably blind or clog up the filter by blocking the openings substantially completely.

It is known in the art to use filter aids which essentially make the single layer filter into a multiple layer filter. This has two advantages, (1) when the particulates are smaller than the openings in the single layer filter medium the filter aid, which is usually comprised of some fibrous material, will form a tortuous passage and/or a smaller opening that prevents small particles from traversing the normal filter opening. Such particulates, however, are distributed at different points or levels through the filter aid or filter as a whole, and thus, do not as quickly block the filter openings or at least allow additional time before the openings become blocked.

On the other hand, if the particulates are larger than the filter medium openings, the use of filter aid materials will tend to prevent such larger particulates from as quickly blinding or blocking the openings. This is because the particulates will tend to be caught in the filter aid material and held away from the smaller openings in the filter thus keeping the filter medium itself from becoming blocked or completely clogged as quickly as would likely otherwise be the case.

The difficulty with the use of filter aid materials is first, that they contaminate any collected filter materials, second, they must be applied between cleaning of the filter, and third, they add extra expense. The use of filter aid materials in a vacuum cleaner or suction system is, needless to say, difficult, if not impossible, to implement and may prevent effective cleaning of the filter.

The filter medium of the invention operates in a different manner from either prior single layer filters or multilayer filters. The filter of the invention is a single layer filter designed to collect particulates much smaller than its nominal orifices, somewhat in the manner of a multilayer filter and furthermore, has been found to be self-cleaning. The filter medium of the invention has flat threads with oblong orifices between the threads which, in aggregate, provide openings substantially larger than the particulates collected. It has been found that commercial shade cloth provides a very satisfactory filter conforming to these requirements. The shade cloth should, it has been found, be from 89% to 95% shade cloth or better yet, 90% to 95% shade cloth, with a preferred range of 92% to 94% shade cloth. As will be understood, such cloth has open areas of from 5% to 11%, from 5% to 10%, or most desirably, of from 6% to 8% open area. The threads are preferably from 0.03 inches to 0.035 inches wide and perhaps 0.005 inches to 0.008 inches thick making them essentially flat and should have a smooth upper surface formed preferably by a smooth plastic or resin such as polyethylene, polypropylene or some other polyolefin or other materials having comparable surface properties or characteristics. While the above dimensions have been found to be very satisfactory, the width of the threads can be desirably from 0.025 inches to 0.045 inches and the thickness can be from 0.005 inches to 0.013 inches with very desirable results.

The width of the openings between the threads can desirably be from 0.003 inches to 0.005 inches and the length can be desirably from 0.010 inches to 0.020 inches. Less preferably, the width could be from 0.002 inches to 0.006 inches and the length be from 0.009 inches to 0.021 inches. The width is the most important dimension as it determines essentially the effectiveness of the filtering. The length of the openings, on the other hand, is important mainly in relation to the strength of the filter material in that the filter material must have sufficient rigidity to maintain the distance between the threads fairly constant.

Consequently, the important characteristic with respect to the length of the openings is the relative continuity of the filter material. A relatively more rigid or stronger filter material or thread will enable relatively longer filter openings to be effectively used. This may be expressed as having a filter opening length such that normal filter configuration is maintained under effective operating conditions or so the structural integrity of the filter openings is maintained.

The filter openings will usually be polygonal, since it is more convenient to form a single layer filter medium with fairly precise openings by the use of rectangularly laid strands in a woof and weave pattern. However, it is believed that the corners of the openings could be rounded without a significant decrease in efficiency and the width of the openings could also vary within reasonable limits from point to point so long as the variation is not too great and the average width falls within the limits set forth. The filter threads may be conventionally woven or may be unitary or directly adhered to each other. The preferred dimensions given are for woven filter cloth and a molded filter cloth construction might have slightly different openings because of a lesser effective gas permiability.

As indicated, the filter medium of the invention is self-cleaning and it is believed this is a result of the structure of the filter and the amount of air passing through it. The filter of the invention has fairly large openings compared to most filters which opening are larger than the material collected. On the other hand, the filter medium has a fairly high ratio of closed space to open space, the closed space, being comprised of substantially flat, smooth surfaces.

When a particulate approaches the filter medium of the invention, it sees in the case of a 92% shade cloth, or a filter medium having similar characteristics, 8% open space and 92% closed space, or, considered in another way, 8% of the particulates approaching the filter "see" open space and 92% "see" closed space. Consequently, the majority of the particulates, in the neighborhood of 85% to 90% perhaps, will impact upon a flat surface and the majority of these will adhere to such surface. Thus, initially, perhaps 10% of the particulates will pass through the filter medium and the other 90% will build up upon the filter. The flat surface of the filter medium encourages retention of the particulates while a rounded surface would encourage deflection of the particulates to the side, many of which would then pass through the openings in the filter medium.

The 10% of the particulate which initially pass through the filter medium of the invention are preferably caught on a secondary filter having a decreased mesh size which may be any conventional suitable filter. It is thus normally important that the primary filter medium of the invention be used in conjunction with a secondary or back-up filter or, in most cases, several consecutive back-up filters. However, the filter medium of the invention can also be used by itself if the escape of an initial 10% or so of the particulates is acceptable in the particular use. In either case, a deposit of particulates very quickly builds upon the filter threads and tends to expand because of the dynamics of the air flow into the open space between the threads of the filter. The relatively large area of closed space, the relatively narrow dimensions between the filter threads and the relatively large area of the individual openings encourage rapid growth of a particulate deposit across the narrow openings which soon, not only narrows the openings, but also quickly bridges them, whereupon the particulate deposit itself acts as a very fine filter rapidly removing very fine particulates from the air stream. Concurrently, the relatively large openings behind the dust and particulate layer continue to allow a relatively large air flow to move through the filter which large air flow tends to hold the particulate layer upon the filter. The effect is enhanced if there is some fibrous material in the particulate material which is the case in most industrial environments.

The particulate deposit on the filter medium tends to build up in layers and will eventually reach a point where the weight of the deposit overcomes the force of the air flow through the deposit and the outer layers of particulates tend to slough off the filter and fall away. The relatively large size and narrow shape of the orifices, however, it is believed, tends to maintain a thin particulate deposit over the filter openings, while the relatively large flat thread areas, which block direct air flow, provide areas where there is little overall force holding the particulate material against the filter medium and where the smooth surface of the filter medium encourage separation. Thus, it is believed, the particulate tends to slough off differentially with the underlying layers immediately around the openings tending to remain in place while the overlying layers of particulates over the openings and adjacent the openings separate together with essentially the entire deposit directly over the more central portions of the flat threads tending to separate from the filter medium adjacent the thread surfaces. The single layer nature of the filter medium of the invention prevents the deposit of particulates from becoming entangled or enmeshed in the strands of a multiple layer filter medium which would prevent the deposit from readily separating from the filter medium. When the particulates slough off and fall into the particulate container underneath, filtering continues and, since a portion of the particulate deposit in the openings tends to remain, the efficiency of the filter medium in removing particulates from the air stream does not decrease substantially, if at all.

It will be recognized from the above explanation of the unparalled and quite unexpected efficiency of the filter medium and vacuum apparatus of the invention, which explanation, it must be emphasized, is theoretical in nature based upon the evidence presently available, that the shape and relative size and disposition of the openings and closed area in the filter medium of the invention together with its use with subsequent conventional filters are quite important to the effective operation of such filter medium. It will also be evident that the new filter medium is not the same as a conventional large mesh filter, but has special and important characteristics necessary for its effective operation which are not characteristic of prior filters.

Reiterating these requirements, it has been found that the filter medium must be comprised of substantially flat individual threads having a width of from 0.025 inches to 0.045 inches and more preferably an individual width of 0.030 inches to 0.035 inches. The threads should have a flat configuration on the pressure side of the filter at least. The openings between the individual threads should be oblong, i.e. longer than they are wide and the width of the openings should be between 0.002 inches and 0.006 inches and preferably between 0.003 inches and 0.005 inches. The length of the openings can be more variable, but must not be so great that it does not maintain the strength of the filter medium. In other words, the width and shape of the filter openings must be maintained and if the cross threads are too infrequent, this cannot be effectively done. On the other hand, the length of the filter orifices cannot be too restricted or short or insufficient air will pass through the openings. As indicated, the filter medium must have from 89% to 95% closed area or conversely 5% to 11% open area through the filter medium. More preferably still, the open area will be 5% to 10%, or more desirably still, 6% to 8% open areas, such open area, of course having an oblong shape with a width of from 0.002 inches to 0.006 inches and more preferably 0.003 inches to 0.005 inches. The width of the individual flat threads should be from 0.025 inches to 0.045 inches and more preferably from 0.030 inches to 0.035 inches. The ratio between the width of the openings and the width of the individual threads should be between approximately 1 to 7 and 1 to 15.

It is also important that a minimum air suction or flow be maintained across the filter and this has been found to be from approximately 40 CFM per square foot to 60 CFM per square foot and most preferably from about 45 CFM per square foot to 55 CFM per square foot. As explained above, it is the air flow which maintains the particulate layer against the filter yet allows layers to slough off periodically. Since a vacuum-type cleaning apparatus is usually exposed to slightly different particulate materials from time to time, there is a tendency for stratification in the layers built up on the filter similar to that seen in geological deposits for the same reason. Such stratification aids in later separation of the outer layers of filtered material when differential air pressure effects become evident.

Figure 9:
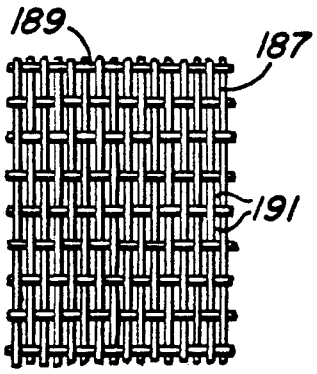
FIG. 9 is an enlarged view of a section of the preferred primary filter medium shown in FIG. 3.

A filter medium such as described above and shown in the form of a dome or drum-type filter element in FIG. 3, is shown in detail in FIG. 9. In FIG. 9 may be seen a plan or top view of a filter fabric 185 comprised of crossed strands 187 and 189 that may, for convenience, be referred to as the woof and the web, or warp strands or threads respectively. As a practical matter, the crossed threads may be either woven threads, or intermatted threads adhered to each other by a thermal process. In the construction shown, the threads are woven and then heat adhered and flattened. It may be noted that the filter openings 191 have a long dimension, or length 193 parallel to strands or threads 187, and a short dimension, or width 195 parallel to the strands or threads 189. The individual threads of the filter medium also have a width 197, which it may be seen is greater than the width 195 of the filter openings 191. The width 197 of the threads or strands 187 and 189, in fact, is generally more or less comparable to the length 193 of the filter openings 191. While the warp and woof threads will usually have the same dimensions, it is possible for the two threads to have different widths. The width of the threads along the lengthwise extent of the individual orifices is more critical than the width of the cross threads, because these are the important threads upon which a filter layer is formed.

Figure 10:
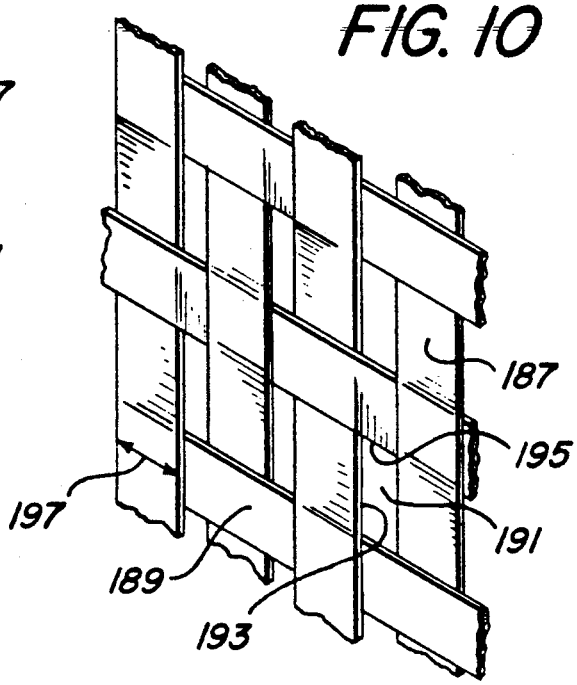
FIG. 10 is oblique enlarged view of the filter medium section of FIG. 9.

FIG. 10 shows an isometric side view of the filter material shown in FIG. 9. It can be seen in FIG. 10 that the component threads of the filter medium are wider than they are thick. It can also be seen how the strands or threads are interpenetrated into each other as a result of a heat flattening operation providing an overall flat weave to the filter material. As indicated above, the openings 191 are preferably from 0.03 inches to 0.035 inches in width and 3 to 6 times their width in length. The threads are preferably 0.030 inches to 0.035 inches in width and may desirably be about 0.006 inches in thickness, although the thickness dimension is not critical.

It will be understood that during operation of the vacuum filter apparatus shown in FIGS. 1, 2 and 3, upon activation of the motor 67 with current from any suitable source, not shown, the centrifugal blades of rotor 64 will be rotated throwing air to the periphery of the centrifugal chamber 62 where it exits from the air passage into the interior of the fan casing 19 and thence through circumferential air ejection passage 68 to the atmosphere. Air to replace the ejected air is drawn into the centrifugal chamber 62 through the air passage 61 through the fine mesh of the HEPA filter 57 and the protecting nylon filter 59 from the chamber 49. Very fine dust may in the process be caught on the filter 59. A plastic or paper particulate bag 60 is preferably positioned in the bottom and sides of the filter chamber 62. As air is exhausted or drawn from chamber 49 of the second stage filter apparatus, it is replaced by air drawn through the suction tube 31 from within the filter casing 17 drawing air in turn through the filter medium 45 which removes the majority, or almost all, of the dust particles from the air. A previous accumulation of dust upon the filter medium aids in removing small dust particles from the air, that is to say smaller particulates than would normally be stopped by the mesh of the filter 45.

Air passing through the filter 45 is replaced in chamber 37 by air drawn through vacuum suction hose 27 and suction pipe 29. The air stream passing through suction hose 27, of course, draws in dust and dirt from the environment immediately adjacent and surrounding the end of the suction hose 27 or any suction tool or other device mounted on the end of the hose. An equal pressure, or vacuum, is established in the bottom of the tank 13 on the outside of the plastic bag 39 and this equal pressure, or vacuum, maintains the plastic bag 39 in the bottom of the tank 17 and prevents it from being drawn up into the filter 45.

It will be understood that as dirt and particulate laden air is drawn downward through the suction pipe 29 at high velocity and suddenly expands into the large space 37 in the tank 13, the sudden slowing down and expansion of the air stream as it enters the larger space 37 within the plastic bag 39 will cause a large amount of particulates to drop by gravity out of the air stream and fall or settle into the bottom of the bag 39. It is desirable in this respect for the dust-laden air to be directed from the end of the suction tube 29 downwardly directly at the lower portion of the plastic bag 39. The air then is drawn upwardly into the filter 45 through which it passes leaving the major portion of any remaining dust on the inside surface of the filter 45. The deposit of dust and other particulates builds up in filter 45 until the weight of the accumulation causes the outer layers of particulates to be pulled more strongly by gravity than they are forced toward the filter by the air passing through the dust accumulation. At this point, the outer layers of dirt and particulates separate and fall downwardly into the plastic bag 39. A new outer layer of dust and particulates then immediately begins to form upon the base of particulate material already deposited and the cycle repeats itself. The efficiency of the filter thus continues essentially undiminished until the bag 39 accumulates a full load of dirt and debris and must be changed. The point at which this occurs is controlled somewhat by how far the suction pipe 29 extends into the bag 39, as the efficiency of the device will decrease when the level of the particulates reaches the lower end of the suction pipe 29 and then exceeds the level of the lower end of such pipe. When this happens, efficiency is restored when the plastic bag 39 is removed and replaced. The bag is removed by first removing the top 33 of the tank 13. The top of the bag may be closed and secured before removal from the tank 13 in any suitable manner to keep the contents from spilling.

FIG. 4 is a schematic view of a further embodiment of the invention in which there is only a single stage of filtering. Where the parts are the same, the same reference numerals are used as in the multistage embodiment of the invention shown in FIGS. 1 and 2. Thus, there is a tank 13 having a cover 33 with a suction pipe 29 extending therethrough and a filter 45 extending through the top 33 contained within a filter casing 18. A motor 75 is positioned above and mounted on the filter casing 17 above an exhaust port 77 in the top of the filter casing. The motor 75 has a shaft 79 at the upper end upon which are mounted fan blades 81 adjacent to exhaust ports 83 in a motor casing 85. Cooling passages 87 pass from the exterior of motor casing 85 to the lower portion of the motor 75, the lower portion of which is preferably closed to prevent the entrance of dust into the motor with any air in which the dust may be entrained passing through exhaust port 77. Operation of the fan blades 81 draws air through the exhaust port 77 in filter casing 17, draws such air past the motor extracting heat from the motor and by aspiration draws air from the top of the motor and passes it out the exhaust ports 83 with the air from the filter casing 17. The hot air withdrawn from the top of the motor is replaced with cooler outside air drawn through cooling passages 87 into the motor. The filter 45, which in FIG. 4 constitutes the sole filter stage, is the same as in the first stage filter used in the multistage filter arrangement shown in FIGS. 1 and 2. The filter is self-cleaning through the effects of gravity as in the previous embodiment and a very efficient filter system is provided. It will be understood that a plastic bag similar to the plastic bag 39 in space 37 in FIG. 2 may also be used in the apparatus of FIG. 4 with suitable vacuum equalization conduits.

It is generally desirable to use the filter medium of the invention in combination with a second or further stage of filtering so that during the time after initial startup that the particulates are forming a deposit or layer upon the filter medium, the 5% to 10% of the particulates that initially pass through the first stage filter medium are caught by a conventional downstream filter or filters. Since the time during which an initial layer is formed is relatively short, not much of a deposit forms on the secondary filter and replacement of the filters is not frequently necessary. It will be understood that some small particulates may escape through the primary filter at all times and particularly during sloughing off of the outer coatings, but the total particulates passing to the secondary filter or filters is relatively small.

FIGS. 5 and 6 show a further embodiment of the invention. FIG. 5 is a partially broken away side view and FIG. 6 is a top or plan view of the same apparatus with the filter casing removed to show the filter. In FIG. 5 there is seen a portable-type vacuum cleaner comprising an elongated horizontal tank 91 at one end of which is attached a shorter vertical tank 93. Upon the top of the horizontal tank is an elongated filter casing 95 surrounding an elongated inverted filter 97 which is the primary or initial filter of a two-stage filtering arrangement. The elongated inverted filter 97 is made from a plastic material having the same physical and chemical characteristics as the filter 45 in the previously described embodiments, but the filter has a different, i.e. a more elongated shape, to adapt it to the shape of the other components of the vacuum. Within tank 91 is a particulate collection space 99 into which dust and particulates pass after passing through vacuum hose 101 and vacuum inlet 103 in the end closure 105 of the tank 99. Hinged clamps 107 of any suitable type hold the end closure 105 to the end of the tank 91 during operation. The upright tank 93, which is attached to the opposite end of the tank 91, is connected to the inside of the filter casing 95 by vacuum tube or main 109. The lower portion 111 of tank 93 constitutes a dust accumulation chamber 112, only partially shown, into which extends a perforate filter holder or mounting 113 over which is mounted a fine mesh cloth or paper filter or alternatively, a HEPA filter 115. The filter holder 113 connects to the bottom of a fan casing 117 in which the rotor 119 of a centrifugal-type fan operates on the shaft 121 of a motor 123. Air cooling passageway 125 leads from the exterior of the tank 93 to the motor 123 to cool the motor and there are also exhaust orifices 127 in the side of the tank 93 to exhaust air derived both from the centrifugal rotor 119 and cooling air from the interior of the motor 123. Wheels 129 and swivel caster 131 provide mobility to the vacuum apparatus. A hinged door or trap 133 provides access to the interior of the dust accumulation chamber 112 for removal of debis and the like. A protective nylon or paper filter 116 may surround the HEPA or other filter 115.

In operation, upon activation of the motor 123 the centrifugal rotor 119 withdraws air from inside the filter holder 113 which causes air to pass through the filter 115 to replace the exhausted air. Fine particles of dust are removed from the air as it passes through the filter 115 and air is withdrawn from the filter casing 95 through vacuum tube 109 to replace the air. Dust particles tend, after passing through tube 109 into dust accumulation chamber 112, to fall to the bottom of the chamber and accumulate in the bottom. Any very fine dust passes with the air to the filter 115 for final removal. The air exhausted from the filter casing 95 is replaced by air from the particulate accumulation chamber 99 which air passes through the filter medium 97 where most of its dust and particulate content is removed. As in the previous embodiments, the dust layers build up on the inside of the filter 97 initially increasing the filtering efficiency and finally the outer layers of dirt slough off and fall into the bottom of the dust accumulation chamber 99. The dust and other particulates, which originally passed through the hose 101 and vacuum inlet with indrawn air can be removed from the chamber 99 by disengaging the hinged clamps 107 and removing the end closure 105 while inclining the entire vacuum device so accumulated particulates slide out. All internal surfaces of the filter 97, i.e. the dust or particulate collecting surfaces of the filter, should be disposed at an angle of from 90 to 180 degree of horizontal, i.e. be vertical or else at least partially downward facing, in order to facilitate self-cleaning of the filter. It is also desirable for the apparatus in FIGS. 5 and 6 to be provided with a plastic collection bag similar to that shown in FIGS. 1 and 2.

FIG. 7 is a schematic representation of a three-stage filter arrangement in accordance with the invention. The apparatus of FIG. 7 is comprised essentially of two tanks 135 and 137. The first tank 135 has a filter casing 139 within which is an inverted primary filter 141. A vacuum inlet 143 passes into the central portion of the tank 135 to discharge particulate laden air into the particulate collection space 145 within an impervious plastic bag 147. The plastic bag is secured to a circumferential clamp 148 which secures the top of the bag. A pressure equalization passage 149 connects the lower portion of the tanks 135 and 137. A vacuum tube or main 151 also extends from and interconnects filter casing 139 with tank 137. A perforate filter holder 153 is supported on a partition 155. Baffles 157 are attached to the top of filter holder 153 so that air passing through the filter holder 153 is accelerated and centrally directed. The baffles also at least partially prevent detritus from falling through the filter holder. There is a second perforate filter holder 159 secured in place on semicircular partitions 158 above the first holder 153. A large fan 161 is located in the top of the tank 137 above the second filter holder 159. The fan 161 is rotatably supported on shaft 163 of motor 165 which is mounted in turn on supporting brackets 167 all within a motor casing 169. A circumferential exhaust passage 166 exhausts air drawn through the fan 171 to the exterior of the apparatus. A secondary filter 154 is mounted on the filter holder 153 and extends into the second filter section or space 156. A tertiary filter 160 is secured upon the second filter holder 159 and is contained in the third filter section or space 162. Cleanout openings with a hinged cover 168 are provided in the bottom of the tank 137 in both the secondary and tertiary filter sections.

It will be recognized that the fan 161 pulls or sucks air and debris through filters 160 and 154. Air in turn passes through the filter 141 and into the filter casing 139 from where it passes via the vacuum tube or main 151 into the second filter section 156. Pressure equalization passage 149 allows the reduced pressure in the second filter section 186 in the bottom of tank 137 to be transferred to the bottom or lower end of tank 135 to retain the impervious plastic bag 147 in the lower portion of the tank. As in the earlier embodiments of the invention, dust and other particulates build up on the inverted filter 141, and after a certain amount of such material has collected, the outer layer will slough off to renew the filter surface.

Figure 8:
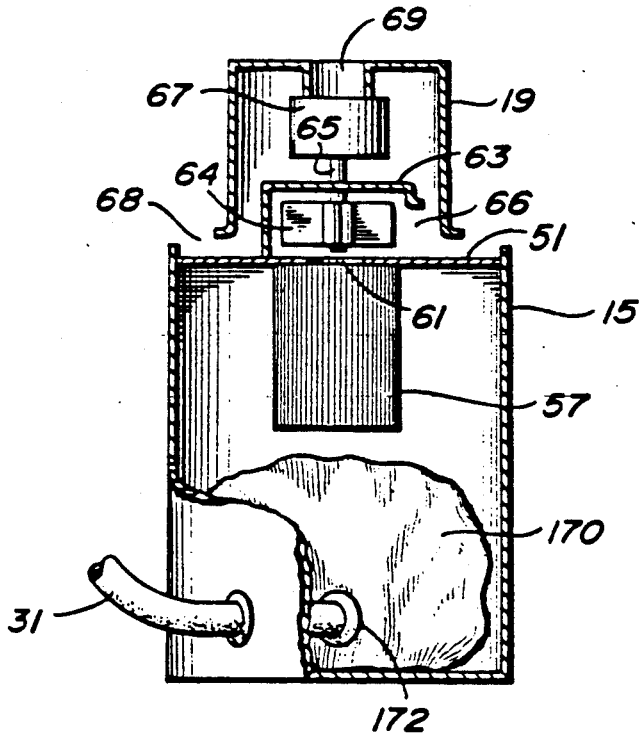
FIG. 8 is a broken away elevation of an alternative embodiment of the second stage of the invention.

FIG. 8 is a broken away elevation showing the inside of the second stage or second tank of a very desirable alternative embodiment of the cleaner shown in FIGS. 1 and 2. In such alternative embodiment, the plastic particulate bag 60 is replaced by a paper filter bag 170 into which the suction tube 31 passes with a tight fitting substantially dust proof connection 172 as known in the art. This arrangement effectively converts the cleaner shown in FIGS. 1 and 2 into a three stage rather than a two stage cleaner, which is extremely efficient in operation and dust removal. The other elements of the apparatus shown in FIG. 8 are the same as in FIGS. 1 and 2 and the same reference numerals are used to refer to the same structures. The paper filter bag, after becoming full of particulates, may be readily removed from the tank 15 by removing the cover 51 and the contents of the paper filter bag 170 disposed of, or, more frequently, the entire bag will be disposed of. One of the advantages of paper filter bags is disposability. Since the filter 45 is so efficient, and substantially self-cleaning besides, the filter bag or container 170 or its contents needs to be removed and disposed of only infrequently. The nylon plastic filter 49 may or may not be used over the HEPA filter 57 as shown in FIG. 2 when the improved arrangement shown in FIG. 8 is used since the paper filter bag 170 does an excellent job of removing excess particulates and dust from the discharge from vacuum tube 31 prior to contact with the HEPA filter. The fine plastic filter medium 59 is consequently not shown in FIG. 8. However, it will be understood that additional protection for the HEPA filter will be provided by the use of a filter 59 as shown in FIG. 2.

The same paper filter bag arrangement as shown in FIG. 8 may be used with the three stage cleaner shown in FIG. 7 and if used, will effectively convert the embodiment of FIG. 7 into a four stage, as contrasted to a three stage, cleaner with additional efficiency and effectiveness, particularly where very fine dust and particulates are to be removed from a large amount of air. In using a paper filter bag 170 as shown in FIG. 8 in the embodiment shown in FIG. 7, it may be desirable to enlarge the lower clean out door 168 to facilitate removal and replacement of such filter bag when necessary.

It may be convenient where a paper filter bag as shown in FIG. 8 is used in the apparatus of FIG. 2 to have the suction tube or main 31 pass through the lid 51 of the tank 15 as a rigid tube and be connected with the paper filter bag 17 by means of a flexible tubing.

Figure 11:
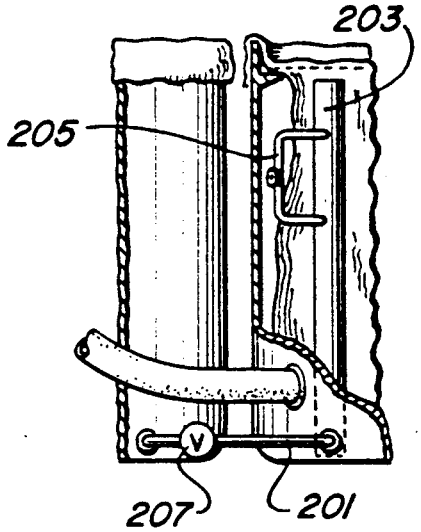
FIG. 11 is a partial view of a further embodiment of the invention adapted especially for handling moist material.

FIG. 11 is a partial view of an apparatus similar to that shown in FIG. 2, showing an improved embodiment of the invention, including a so-called equalizer arrangement that adapts the apparatus particularly for use in vacuuming wet materials. Similar components in FIG. 11 to those shown in FIGS. 1 and 2 are identified by the same reference numerals. Only the adjoining portions of the two tanks or receptacles 13 and 15 are shown in FIG. 11.

As noted above, the vacuum arrangement and filter of the invention are useful not only for use in vacuuming dry materials, but have been found very useful also for vacuuming wet materials and can, in fact, be very efficiently used to vacuum up moisture or liquid distributed over a surface. In such case, most, if not all of the moisture ends up in the plastic collection bag 39 shown in FIG. 2. Moisture which passes through the filter 45 is usually vaporized and passes through the apparatus as vapor so it does not seriously wet the filters subsequent to the first filter medium. However, all moisture which collects in the plastic bag 39 tends to sink after a time, under the influence of gravity, to the bottom of the bag.

Consequently, if the bag should have an opening such as a tear or the like, particularly near the bottom, the moisture will tend to escape into the bottom of the tank or receptacle 13 where it may be drawn out through the vacuum take-off 47 into the suction tube 31 which then deposits the moisture, usually in the form of liquid, in the tank 15, where it will have a very deleterious effect upon any paper or cellulose filters or collection bags. The liquid is particularly likely to be drawn from the tank 13 during startup of the apparatus after an interruption in operation before the pressure reaches equilibrium throughout the system.

In order to remedy the disadvantages of moisture entering the tank 15, it is preferred when wet materials are being handled, to replace the vacuum take-off 45 shown in FIGS. 1 and 2, with the equalizer take-off tube 201 shown in FIG. 11. This equalizer tube 201 passes through the wall of the tank 15 and is connected with a vertical equalizer tube or stand pipe 203 within the tank 15. The vertical equalizer tube 203 extends upwardly within the chamber 49, as shown in FIG. 11, close to the top of the chamber.

Upon startup of the vacuum apparatus, if moisture or water is present outside the plastic bag 39 in tank 13, it will initially be drawn into the equalizer tube 201 and equalizer standpipe 203. However, it tends to rise in the vertical tube 203 only so far, depending upon the strength of the vacuum, and then as the pressure in the tanks 13 and 15 is more or less equalized, or stabilized, such moisture will tend to drain back into the tank 13 where it will be noted and removed when the collection bag 39 is changed. Alternatively, a sight tube 205 or the like may be provided on the side of the tank 15 connected with the vertical equalizer tube 203 so the operator may note whether moisture appears upon startup of the apparatus. A tap valve 207 may also be provided to aid in draining moisture from the system while the vacuum is deactivated.

As will be recognized, the equalizer arrangement shown in FIG. 11 prevents liquid from entering the chamber 49 and interferring with its operation. Although the top of the vertical equalizer tube 203 is open to the chamber 49, any moisture which tends to escape from the top tends to escape by evaporation and the vaporized moisture does not harm the filter apparatus in tank or receptacle 15.

Applicant's previous U.S. application Ser. No. 047,894, upon which the present application is a continuation-in-part, described and claimed the invention including preferred and less preferred ranges as the invention was understood at that time and it has been actually used. However, continuing investigation has revealed additional requirements for best practice of the invention and has revealed also even more desirable preferred ranges which have been set forth and claimed herein as well as other improvements.

It will be understood that although the present invention has been described in considerable detail in connection with the accompanying figures and description, all such description and showning is to be considered as illustrative only and the invention is not intended to be narrowly interpreted in connection therewith, but should be interpreted broadly within the scope of the delineation of the invention set forth in the accompanying claims.

I claim:

1. A method of filtering particulates from a gas stream comprising:

(a) passing said gas stream through a relatively transversely confined space into a substantially less confined space to cause entrained particulates to settle by gravity from said gas, (b) passing said gas upwardly into an open-bottom-closed-top filter confirmation formed from smooth polymer fabric material comprised of a plurality of intersecting filter threads from 0.025 inches to 0.045 inches wide positioned with substantially a flat surface of the filter threads on the pressure side of the filter and any curved surface on the threads on the decreased pressure side of the filter, said threads defining filter openings having an oblong configuration from 0.002 inches to 0.006 inches in width and a length of between 0.009 and 0.021 inches which is not greater than will maintain the structural integrity of the filter openings and having an open-to-closed ratio of 5% to 11% and a total open area of 12 or more times the cross-sectional area of the relatively transversely confined space at a rate such that a portion of the particulates in the gas are drawn upwardly with the gas, (c) continuing passing the gas through the filter medium and allowing particulates to build up on the filter medium on the sides and top of said filter medium until sufficient particulate material is present such that the weight of the outer layers of particulates at least is greater than the adhesion of the particulates together plus the force of the gas passing through the particulates, (d) allowing outer portion f the particulate layers to slough off and fall away under the influence of gravity, (e) catching any particulates that may pass through the filter during sloughing off of the particulate layers on the filter on at least on subsequent filter having a smaller filter opening size, and (f) repeating steps (a) through (e),

2. A method in accordance with claim 1 wherein the air is passed through a filer having an open area ratio of 6 to 8 and a total opening area of 8 to 48 times the area of the transversely confined space.

3. A flexible fabric filter arranged and constructed or use in self-cleaning vacuum-type suction cleaners comprising:

(a) a filter fabric dimensioned and having a three-dimensional shape specifically adapting such fabric filter for use in a vacuum apparatus said fabric filter being formed from a plurality of intersecting filter threads formed of a polymer material, (b) the individual threads of said fabric filter being substantially flat on the pressure side of the fabric filter as it is arranged and constructed for mounting in self-cleaning vacuum-type suction cleaners, (c) said threads defining filter openings having an elongated configuration 0.002 inches to 0.006 inches wide and having a length between 0.009 to 0.021 inches which will not tend to decrease the structural integrity of the filter openings, (d) the filter material threads defining the sides of the filter openings having a width of from 0.025 inches to 0.045 inches, (e) the total open area of the filter material being from 5% to 11% of the total area of the filter material.

4. A flexible fabric filter in accordance with claim 3 wherein the filter openings are from 0.003 inches to 0.005 inches in width.

5. A flexible fabric filter in accordance with claim 3 wherein the threads are 0.03 inches to 0.035 inches in width.

6. A flexible fabric filter in accordance with claim 3 wherein the open area of the filter material is 6% to 8%.

7. A flexible fabric filter in accordance with claim 3 wherein the width of the filter threads is 0.03 inches to 0.035 inches, the thickness of the filter threads is 0.05 inches to 0.013 inches, the width of the filter openings is 0.003 inches to 0.005 inches and the open area of the filter material is 6% to 8%.

8. A self-cleaning high vacuum-type suction cleaner comprising:

(a) a particulate receiver, (b) a flexible fabric filter having a relatively large mesh size disposed above and in effective contact on one side with the particulate receiver and on the other side with a vacuum enclosure connected to a rotatable suction means, (c) an inlet into the particulate receiver for particulate laden air, said inlet opening into the receiver below the large mesh fabric filter in a downward direction away from said filter, (d) said flexible fabric filter being:

(i) formed from a plurality of intersecting filter threads formed of a polymer material, (ii) the individual threads of said filter cloth being substantial flat on the pressure side of the filter material, (iii) said threads defining filter openings having an elongated configuration 0.002 inches to 0.006 inches wide and having a length between 0.009 to 0.021 inches which will maintain the structural integrity of the filter openings, (iv) the filter material threads defining the sides of the filter openings having a width of from 0.025 inches to 0.045 inches, (v) the total open area of the filter material being from 5% to 11% of the total area of the filter material.

9. A self-cleaning suction cleaner in accordance with claim 8 wherein the filter openings in the flexible fabric filter are from 0.003 inches to 0.005 inches in width.

10. A self-cleaning suction cleaner in accordance with claim 8 wherein the threads of the flexible fabric filter are 0.03 inches to 0.035 inches in width.

11. A self-cleaning suction cleaner in accordance with claim 8 wherein the open area of the filter material is 6% to 8%.

12. A self-cleaning suction cleaner in accordance with claim 8 wherein the width of the filter threads is 0.03 inches to 0.035 inches, the thickness of the filter threads is 0.05 inches to 0.013 inches, the width of the filter openings is 0.003 inches to 0.005 inches and the open area of the filter material is 6% to 8%.

13. The suction cleaner of claim 8 wherein the large mesh fabric filter has a hollow open bottom form.

14. The suction cleaner of claim 13 wherein the large mesh fabric filter has substantially vertical side panels.

15. The suction cleaner of claim 8 wherein the cleaner is a plural stage cleaner having at least one additional filter of lesser mesh size than the large mesh size fabric filter disposed downstream of said large mesh size filter with respect to the flow of gas through said filters.

16. The suction cleaner of claim 15 wherein the particulate receiver is arranged and constructed to receive a substantially impervious disposable bag in the lower portion thereof.

17. The suction cleaner of claim 16 wherein the lower portion of the particulate receiver is connected to a vacuum source to maintain impervious bags in the bottom portion of said receiver away from the fabric cloth.

18. The suction cleaner of claim 17 wherein the vacuum source is a second stage filter chamber containing an additional filter and the connection between the particulate receiver and the second stage filter chamber includes an elevated equalizer tube extending upwardly in such chamber to retain moisture from being drawn from the particulate receiver when vacuuming wet materials if the plastic bag should be perforated.

* * * * *